United States Patent [19]

Schloesser et al.

[11] 4,020,851

[45] May 3, 1977

[54] APPARATUS FOR MONITORING THE OPERATION OF CIGARETTE MAKING MACHINES OR THE LIKE

[75] Inventors: Andreas Schloesser; Gerhard Ramsch, both of Hamburg, Germany

[73] Assignee: Hauni-Werke Korber & Co., KG, Hamburg, Germany

[22] Filed: June 14, 1976

[21] Appl. No.: 695,843

[30] Foreign Application Priority Data

June 19, 1975 Germany ..... 2527329

[52] U.S. Cl. ..... 131/21 B; 198/857

[51] Int. Cl.[2] ..... A24B 7/14; A24C 5/32

[58] Field of Search ..... 131/21 R, 21 B, 20 R; 198/460, 466, 857

[56] References Cited

UNITED STATES PATENTS

| | | | |
|---|---|---|---|
| 2,345,355 | 3/1944 | Neal | 198/857 |
| 2,954,775 | 10/1960 | Radley et al. | 131/21 B |
| 3,355,592 | 10/1967 | Muir | 131/21 B |
| 3,565,236 | 2/1971 | Southworth et al. | 198/460 |

*Primary Examiner*—Stephen C. Pellegrino
*Attorney, Agent, or Firm*—Peter K. Kontler; John Kurucz

[57] ABSTRACT

The absence of continuity of a single file of rod-shaped articles which are formed by the cutoff of a cigarette or filter rod making machine is monitored by an apparatus having two spaced-apart air discharging nozzles one of which is located upstream and the other of which is located downstream of the accelerating cam which propels successive articles of the file into successive flutes of a row-forming drum. At least one of the nozzles is sealed by an article when the machine produces a continuous file of articles. If both nozzles can discharge air at the same time, the pressure in a conduit which communicates with the nozzles decreases and such drop in pressure is detected by a diaphragm transducer or by the cylinder and piston unit of a pneumatic bridge circuit. This results in the generation of a signal which is used to arrest the prime mover of the machine.

12 Claims, 4 Drawing Figures

APPARATUS FOR MONITORING THE OPERATION OF CIGARETTE MAKING MACHINES OR THE LIKE

BACKGROUND OF THE INVENTION

The present invention relates to machines for the production and/or processing of rod-shaped articles which constitute or form part of smokers' products. Such articles include plain or filter tipped cigarettes, cigars, cigarillos and filter elements of unit length or multiple unit length. More particularly, the invention relates to improvements in apparatus for monitoring certian parts or units of such machines for the presence or absence of rod-shaped articles. Still more particularly, the invention relates to apparatus which can be used to determine the continuity or lack of continuity of a file of rod-shaped articles wherein the articles are located one behind the other and move lengthwise. Such files of articles develop in a machine for the making of plain cigarettes, cigars or cigarillos as a result of subdivision of a continuous tobacco-containing rod into discrete rod-shaped articles, as well as in a filter making machine wherein a rod containing acetate fibers or other suitable filter material is subdivided into discrete rod-shaped sections or filter elements of desired length. The invention will be described in connection with the making of plain cigarettes; however, it is to be understood that machines for the production of plain cigarettes constitute but one of several types of machines which can embody or which can be combined with the improved apparatus. The aforementioned machines for the making of filter elements are another typical example of machines wherein the monitoring apparatus of the present invention can be put to use.

A machine for the making of plain cigarettes includes a distributor which forms a continuous tobacco stream, one or more trimming or equalizing devices which convert the stream into a rodlike tobacco filler, means for draping a web of cigarette paper around the filler to form a continuous rod, and a cutoff or analogous means for subdividing the rod into plain cigarettes of desired length. Plain cigarettes which are obtained as a result of severing of the rod form a normally continuous file, and successive cigarettes of such file are caused to advance past a rotary cam which accelerates the cigarettes and causes them to enter successive flutes of a rotary drum-shaped row forming conveyor. The latter converts the file into one or more rows wherein the cigarettes move sideways, and such rows are advanced into a filter cigarette making machine, into a charger or tray, or to the magazine of a packing machine.

If the continuity of the file is interrupted, e.g., as a result of breakage of the rod and/or cigarette paper web, the prime mover of the machine should be arrested with a minimum of delay in order to avoid a pileup of tobacco, cigarette paper and/or cigarettes. To this end, the file of cigarettes is monitored (normally in the region of the cutoff) in order to immediately detect the absence of cigarettes and to produce a signal which is used to arrest the prime mover so that the attendants can eliminate the cause of malfunction and restart the machine as soon as possible.

Presently known monitoring apparatus comprise photoelectric cells which are mounted adjacent to the path of movement of the file of cigarettes downstream of the cutoff. If the interval between the passage of two successive cigarettes between the light source and the photoelectric transducer of the cell is too long, the transducer transmits a signal which is amplified and used to arrest the prime mover of the machine. A drawback of such apparatus is that their operation is unduly affected by solid particles (especially tobacco dust) which are invariably present in the area surrounding the cutoff. Such particles settle on the lens system of the cell and/or light-sensitive surface of the transducer and prevent the cell from producing a signal in response to absence of cigarettes at the monitoring station. The situation is aggravated if the prime mover of the cigarette maker also serves to drive at least one other machine, such as a filter cigarette making machine. This compounds the losses in tobacco and filter material, especially in a modern production line which turns out up to and in excess of 70 smokers' products per second.

SUMMARY OF THE INVENTION

An object of the invention is to provide a simple, reliable and compact apparatus which can be used in cigarette making and analogous machines to rapidly and invariably detect the absence of rod-shaped articles and to initiate the stoppage of the prime mover with a minimum of delay, not only under normal circumstances but also under circumstances when a conventional apparatus cannot or is unlikely to detect the absence of articles.

Another object of the invention is to provide an apparatus whose operation is not affected by tobacco dust and/or other solid particles.

A further object of the invention is to provide an apparatus which can be incorporated in or combined with existing cigarette making and analogous machines.

An additional object of the invention is to provide an apparatus which can be used in existing machines to rapidly detect the lack of continuity of a file of rod-shaped articles which constitute or form part of smokers' products.

An ancillary object of the invention is to provide the apparatus with novel and improved means for initiating the generation of signals in response to detection of absence of rod-shaped articles in a selected unit of a cigarette making or analogous machine.

The invention is embodied in a machine for the production and/or processing of rod-shaped articles, particularly articles (such as plain cigars, cigarettes or cigarillos, or filter elements) which constitute or form part of rod-shaped smokers' products. The machine comprises means for transporting a normally continuous file of discrete rod-shaped articles lengthwise into a first portion of an elongated path (such transporting means may include a garniture or analogous means for advancing a continuous rod of tobacco or filter material and a cutoff for subdividing the moving rod into a continuous file of articles), a rotary accelerating cam or analogous means for moving successive articles of the file away from the next-following articles in a second portion of the path so that neighboring articles of the file are spaced apart from each other by a predetermined distance not later than in the second portion of the path, means for conveying discrete streams of a gaseous testing fluid across the second portion of the path including two nozzles which are spaced apart from each other (as considered in the direction of lengthwise movement of articles) and at least one of which is at least partially sealed by articles in the second portion of the path as long as the transporting means feeds a continuous file of articles into the first portion of the path, conduit means which communicates with the nozzles so that the pressure of testing fluid in the conduit means depends on the number of nozzles which are sealed by articles in the second portion of the path, and means for monitoring the pressure of testing fluid in the conduit means. The monitoring means may comprise a diaphragm transducer, a pneumatic bridge circuit or analogous means for producing a signal when the pressure of testing fluid in the conduit means corresponds to that at which neither of the two nozzles is sealed by articles. The signal can be used to arrest the prime mover of the machine by way of an amplifier or the like.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
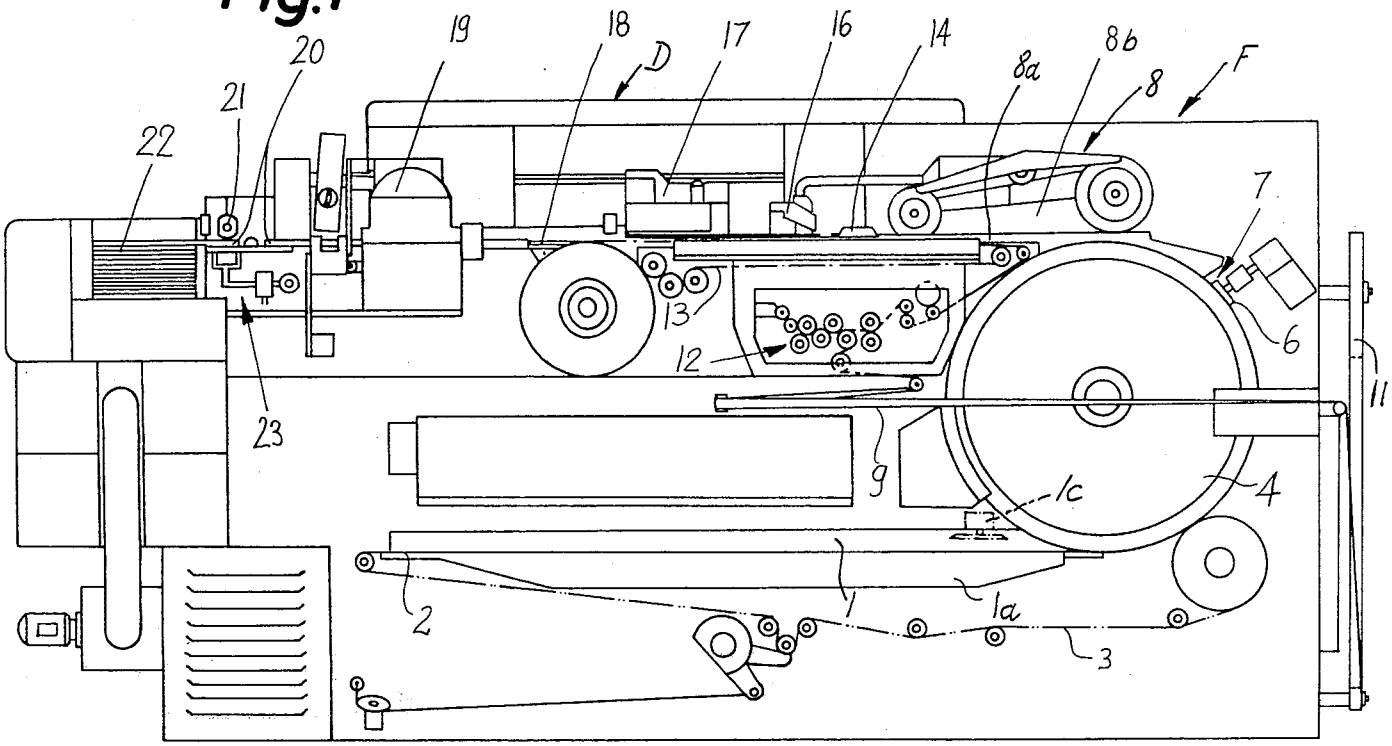
FIG. 1 is a schematic front elevational view of a cigarette making machine including a monitoring apparatus which embodies one form of the invention.

FIG. 1 shows a cigarette making machine of the type known as GARANT (trademark) produced by Hauni-Werke Korber & Co. KG, Hamburg, Federal Republic Germany. The machine comprises a distributor D which is mounted in or on a machine frame F and causes a wide shower of tobacco particles to descend into an elongated channel 1 onto the upper reach of an endless foraminous conveyor belt 3 which travels above the preferred top wall 2 of a suction chamber l*a*. The thus obtained narrow tobacco stream contains a surplus of tobacco particles and is advanced past a first trimming or equalizing device l*c* prior to transfer into the circumferential groove of a suction wheel 4. The groove surrounds a foraminous bottom wall which surrounds a stationary suction chamber in the conveyor 4 so that the once-trimmed tobacco stream adheres to the bottom wall and is advanced past a second trimming or equalizing device 6 which converts the stream into a rod-like tobacco filler 7. A transfer conveyor 8 has a foraminous endless belt 8*a* which travels below the open underside of a suction chamber 8*b* and transfers the filler 7 onto a web 9 of cigarette paper which is withdrawn from an expiring roll 11 by the upper reach of an endless band conveyor 13 known as garniture.

On its way toward the upper reach of the garniture 13, the web 9 passes through an imprinting mechanism 12 which applies to longitudinally spaced portions of the web one or more indicia representing the name, trademark and/or other information pertaining to the manufacturer, the brand name of the cigarette or both.

Figure 2:
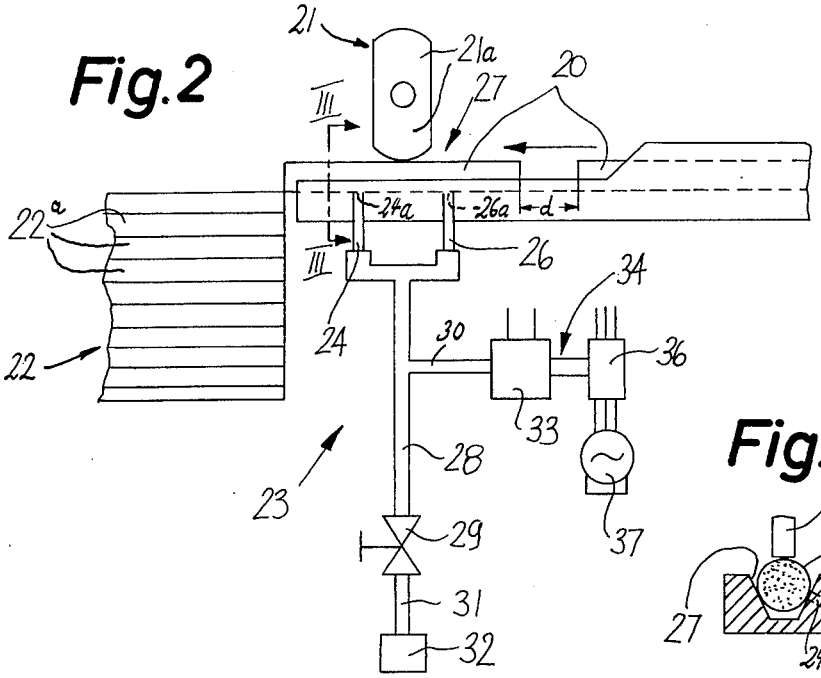
FIG. 2 is an enlarged view of the monitoring aparatus in the machine of FIG. 1.
Figure 3:
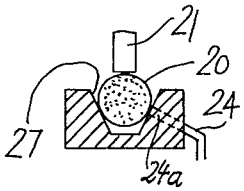
FIG. 3 is a transverse sectional view as seen in the direction of arrows from the line III—III of FIG. 2.

The garniture 13 moves the web 9 and the filler 7 through a wrapping mechanism 14 wherein the web is draped around the filler so that one of its marginal portions extends tangentially of the filler. Such marginal portion is coated with adhesive during travel along a paster 16 and is thereupon folded over the other marginal portion to form therewith a seam extending longitudinally of the thus obtained continuous cigarette rod 18. The seam is heated by a sealer 17 which promotes the setting of adhesive. The rod 18 thereupon enters a cutoff 19 which severs the rod at regular intervals to form a single file of plain cigarettes 20 which move past a rotary accelerating cam 21 having one or more lobes 21*a* (FIG. 2) which propel successive cigarettes into successive peripheral flutes 22*a* of a rotary drum-shaped conveyor 22. This conveyor converts the single file into one or more rows wherein the cigarettes 20 move sideways, e.g., toward and onto the upper reach of a belt (not shown) which transports the cigarettes to a tray filling device, to a filter cigarette maker, or to a packing machine, not shown. The garniture 13 and the cutoff constitute a means for forming and moving a normally continuous file of cigarettes 20 into a first portion of an elongated horizontal path which extends from the cutoff to the conveyor 22. The accelerating cam 21 is adjacent to a second portion of such path and serves to move each preceding cigarette forwardly and away from the next-following cigarette in order to make sure that each cigarette can enter a flute 22*a* without any interference on the part of the next-following rod-shaped article.

the improved aparatus 23 monitors the file of cigarettes 20 in the second portion of the aforementioned path between the cutoff 19 and conveyor 22, i.e., in the region of the accelerating cam 21. The details of this apparatus are shown in FIGS. 2 and 3. The path is defined by an elongated trough-shaped guide 27 which is open at the top (see particularly FIG. 3) so as to enable the lobes 21*a* of the rotating cam 21 to reach successive cigarettes 20 and to increase the spacing between neighboring cigarettes before such cigarettes reach the conveyor 22. The average distance between an accelerated cigarette and the next-following cigarette is shown at *d*.

The apparatus 23 comprises two nozzles 24, 26 which are spaced apart from each other, as considered in the direction of movement of cigarettes 20 in the guide 27, by a distance which exceeds the distance *d* but is at least slightly less than the length of a discrete cigarette. The nozzles 24, 26 are located at the opposite sides of the accelerating cam 21 (the latter is preferably disposed midway between the nozzles) and have orifices 24*a*, 26*a* which communicate with the interior of the guide 27. A source 32 of compressed air is connected with the nozzles 24, 26 by way of conduits 28, 31 and an adjustable pressure reducing valve 29. The conduit 28 has a branch conduit 30 wherein the pressure of air varies in dependency on the number of orifices (24*a*, 26*a*) which are sealed by cigarettes 20 in the guide 27. The pressure in the branch conduit 30 is monitored by a detector 33 which produces an electric signal when the pressure in the conduit 30 drops below a predetermined value, namely, when the nozzles 24, 26 simultaneously convey discrete streams of air across the path of cigarettes 20 in the guide 27. The detector 33 may comprise a diaphragm whose position changes in dependency on changes of air pressure in the conduit 30 and which opens or closes an electric switch when the air pressure is low because neither of the orifices 24*a*, 26*a* is sealed by cigarettes 20 in the guide 27. The output 34 of the transducer 33 is connected with an amplifier 36 which is in circuit with the prime mover 37 of the cigarette making machine. The amplifier 36 arrests the prime mover (the latter may constitute a variable-speed electric or fluid-operated motor) when the output 34 transmits a signal in repsonse to a drop of air pressure in conduit 30 below the aforementioned value.

Before the attendant starts the prime mover 37, the valve 29 is adjusted while the nozzle 24 or 26 is sealed. The pressure in the conduit 30 should be sufficiently high to prevent the transducer 33 from transmitting a signal to the amplifier 36 when at least one of the orifices 24*a*, 26*a* is sealed. When the prime mover 37 is started, the machine begins to produce a continuous rod 18 which is severed by the cutoff 19 so that the right-hand portion of the guide 27 receives a continuous file of coaxial plain cigarettes 20 of unit length. Successive cigarettes of such file are accelerated by the cam 21 which moves each cigarette forwardly and away from the next-following cigarette to establish the distances *d*. Since each of the distances *d* is less than the distance between the orifices 24*a*, 26*a*, the foremost non-accelerated cigarette reaches and seals the orifice 26*a* before the trailing end of the last accelerated cigarette moves beyond the orifice 24*a*. In other words, at least one of the orifices 24*a*, 26*a* is invariably sealed as long as the parts 13, 19 feed a continuous file of cigarettes into the right-hand portion of the guide 27. The pressure of air in the branch conduit 30 is then high enough to prevent the transducer from transmitting a signal to the amplifier 36 so that the prime mover 37 is on and insures continuous operation of the machine. FIG. 2 shows that a single cigarette 20 can simultaneously seal both orifices 24*a*, 26*a* because the length of a cigarette preferably exceeds the distance between the nozzle 24, 26.

If the rod 18 breaks in the region of the cutoff 19, or if the cigarette paper web 9 breaks, the continuity of the file of cigarettes entering the guide 27 is interrupted so that the orifices 24*a*, 26*a* simultaneously convey discrete streams of air across the path of cigarettes in the guide 27. The pressure of air in the branch conduit 30 drops sufficiently to enable the output 34 of the transducer 33 to transmit a signal to the amplifier 36 which immediately arrests the prime mover 37. The prime mover 37 is arrested after the cam 21 completes the propulsion of the last cigarette 20 of the file into a flute 22*a* of the conveyor 22. By way of example, the signal at the output 34 of the transducer 33 may be a voltage signal.

The streams of compressed air which issue from the nozzles 24*a* and 26*a* (when the machine operates properly) blow away tobacco dust and other particles which happen to enter the guide 27. Such particles cannot enter the conduit 28 and thus cannot affect the operation of the monitoring apparatus 23. Owing to such cleaning action of compressed air, the apparatus preferably utilizes a source 32 of compressed testing fluid; however, it is also with the purview of the invention to replace the source 32 with a suction generating device and to use a transducer which produces a signal when the pressure of air in the conduit 30 is such as to be indicative of a situation when the nozzles 24, 26 simultaneously draw air across the path of cigarettes in the guide 27.

Figure 4:
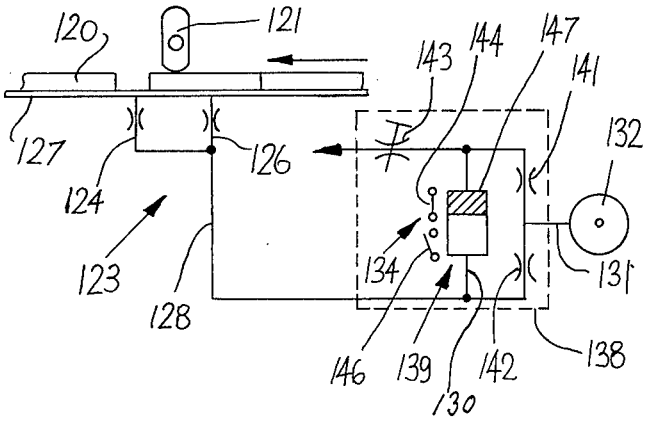
FIG. 4 is a diagrammatic partly sectional view of a modified monitoring apparatus.

FIG. 4 shows a modified apparatus 123. All such parts of the apparatus 123 which are identical with or clearly analogous to corresponding parts of the apparatus 23 are denoted by similar reference characters plus 100. The diaphragm transducer 33 of FIG. 2 is replaced with a modified transducer including a cylinder and piston unit 139 having a magnetic piston 147 which is held in the illustrated end position when at least one of the nozzles 124, 126 is sealed by a cigarette 120. The piston 147 then closes a switch 144 which forms part of the output 134 of the transducer and completes the circuit of the prime mover, not shown. If the guide 127 does not contain a file of cigarettes 120, the nozzles 124, 126 simultaneously convey discrete streams of air (or another gaseous testing fluid) across the path of cigarettes in the guide (at opposite sides of the accelerating cam 121) whereby the pressure in the conduit 130 drops sufficiently to enable the piston 147 to assume its other end position in which the switch 144 opens and the piston 147 closes a second switch 146 of the output 134. The unit 139 forms part of a pneumatic bridge circuit 138 which further includes two fixed flow restrictors 141, 142 and an adjustable flow restrictor 143 whose setting determines that fluid pressure in the conduit 130 at which the piston 147 moves to the other end position. The closing of switch 146 can result in the generation of a visible or audible signal which indicates to the attendant that the machine requires adjustment or repair. As mentioned hereinbefore, the continuity of the file of articles 120 is normally interrupted in response to breakage of the cigarette rod or as a result of breakage of the cigarette paper web.

The conduit 130 branches from the conduit 128 which conveys compressed air from the conduit 131. The latter is connected with the outlet of the source 132.

The operation of the apparatus 123 is not affected by eventual fluctuations of gas pressure in the conduit 131. This is due to the presence of flow restrictors 141, 142.

An improtant advantage of the improved apparatus is that they can invariably produce a signal in immediate response to detection of the breakage of a cigarette rod, cigarette paper web or any other malfunction or defect which affects the continuity of the file of rod-shaped articles in the path defined by the guide 27 or 127. As a rule, the signal is used to effect immediate stoppage of the prime mover.

Another advantage of the improved apparatus is that they need not react to detection of minute deviations of the distance *d* from an optimum distance between two neighboring articles, i.e., that the prime mover is arrested only in the event of a malfunction which is serious enough to warrant a stoppage of the machine or of a group of two or more directly or indirectly coupled machines.

An additional advantage of the improved apparatus is that their operation is not affected by tobacco dust or other impurities at the monitoring station. The self-cleaning action of nozzles which convey streams of compressed gaseous fluid is especially desirable in machines which produce large quantities of tobacco dust.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

What is claimed is:

1. In a machine for the production and/or processing of rod-shaped articles, particularly articles which constitute or form part of smokers' products, a combination comprising means for transporting a normally continuous file of rod-shaped articles lengthwise into a first portion of an elongated path; means for moving successive articles of said file away from the next-following articles in a second portion of said path so that neighboring articles of said file are spaced apart from each other not later than in said second portion of said path; means for conveying discrete streams of a gaseous testing fluid across said second portion of said path, including two nozzles spaced apart from each other, as considered in the direction of lengthwise movement of articles along said path, at least one of said nozzles being at least partially sealed by articles in said second portion of said path as long as said transporting means feeds a continuous file of articles into said path; conduit means communicating with said nozzles so that the pressure of testing fluid therein depends on the number of nozzles which are sealed by articles in said path; and means for monitoring the pressure in said conduit means, including means for producing a signal when the pressure of fluid in said conduit means corresponds to that at which neither of said nozzles is sealed by articles.

2. A combination as defined in claim 1, wherein said transporting means includes means for advancing a continuous rod of tobacco or filter material lengthwise and means for subdividing said rod into said continuous file of rod-shaped articles, said nozzles being adjacent to said moving means and further comprising a prime mover and means for arresting said prime mover in response to said signal.

3. A combination as defined in claim 1, wherein said conveying means further comprises a source of compressed gaseous testing fluid and means for connecting said source with said nozzles.

4. A combination as defined in claim 1, wherein said moving means is located substantially midway between said nozzles.

5. A combination as defined in claim 1, wherein the distance between said nozzles exceeds the distance between spaced-apart neighboring articles in said second portion of said path.

6. A combination as defined in claim 1, further comprising an elongated guide defining said second portion of said path, said nozzles having orifices communicating with the interior of said guide.

7. A combination as defined in claim 6, wherein said guide and said moving means are located at the opposite sides of said second portion of said path.

8. A combination as defined in claim 1, further comprising means for regulating the pressure of testing fluid in said nozzles.

9. A combination as defined in claim 1, wherein said signal producing means comprises a transducer.

10. A combination as defined in claim 9, wherein said transducer is a diaphragm transducer.

11. A combination as defined in claim 1, wherein said monitoring means comprises a pneumatic bridge circuit.

12. A combination as defined in claim 11, wherein said signal producing means comprises a cylinder-and-piston unit in said circuit, said unit having a movable magnet whose position is dependent on the pressure of fluid in said conduit means.

* * * * *